US006914342B1

(12) United States Patent
French

(10) Patent No.: US 6,914,342 B1
(45) Date of Patent: Jul. 5, 2005

(54) ENGINE CONTROL UNIT ENABLEMENT SYSTEM

(75) Inventor: Michael J. French, Pleasant Prairie, WI (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/708,091

(22) Filed: Feb. 6, 2004

(51) Int. Cl.[7] ..... F02N 11/00
(52) U.S. Cl. ..... 290/40 R; 290/39 R; 440/113
(58) Field of Search ..... 290/40 R, 38 R; 307/10.6; 318/150; 123/406.57; 440/113

(56) References Cited

U.S. PATENT DOCUMENTS 3,890,948 A * 6/1975 Minks ..... 123/406.57
5,155,373 A * 10/1992 Tsuchiya et al. ..... 290/38 R
5,155,374 A * 10/1992 Shirata et al. ..... 290/38 R
6,242,887 B1 * 6/2001 Burke ..... 320/104
6,369,532 B2 * 4/2002 Koenen et al. ..... 318/150
6,435,925 B1 * 8/2002 Mabru ..... 440/113
6,557,509 B1 * 5/2003 Hall et al. ..... 123/179.16
6,573,614 B2 * 6/2003 Doll ..... 290/40 C
6,717,291 B2 * 4/2004 Purkey ..... 307/10.6

FOREIGN PATENT DOCUMENTS

EP 137607 A1 * 4/1985 ..... H02J/15/00
GB 2193394 A * 2/1988 ..... H02J/3/16

* cited by examiner

*Primary Examiner*—Joseph Waks
(74) *Attorney, Agent, or Firm*—BRP Legal Services

(57) ABSTRACT

An engine control unit enablement circuit is disclosed that selectively closes a conductive path between a chargeable electrical energy source and electronics of an engine/motor. An engine position sensor provides feedback as to the rotational position of a rotating component of an engine to the enablement circuit. When the rotating component, e.g. crankshaft or flywheel, is rotating, the enablement circuit closes the conductive path and allows the transference of electrical energy from the energy source to the engine and motor electronics. Conversely, when feedback is received indicative of non-rotation of the rotating component, the enablement circuit opens the conductive path. As such, energy stored in the energy source remains stored. With a subsequent detection of rotation of the rotating component, the conductive is closed and the stored energy is allowed to pass to the engine and motor electronics thereby allowing faster powering of the engine and motor electronics.

18 Claims, 3 Drawing Sheets

ENGINE CONTROL UNIT ENABLEMENT SYSTEM

BACKGROUND OF INVENTION

The present invention relates generally to internal combustion engines and, more particularly, to an engine control unit enablement system that stores electrical energy upon engine shut-down such that at a subsequent engine start-up the engine control unit may be powered nearly instantaneously.

Rope-start, two-stroke engines are used in a variety of applications including outboard marine engines, snowmobiles, PWCs, ATVs, motorcycles, and lawn and garden equipment. These engines are started by manually actuating a starter mechanism that drives the engine to rotate. Engine rotation initiates a firing sequence by enabling the supply of electrical power to the engine's fuel injection and/or ignition systems that are dynamically controlled by an engine control unit. The most common manually actuated starter mechanism includes a rope that is wound around a spool coupled to the engine's flywheel either directly or via one or more gears. The rope unwinds from the spool when it is pulled by the operator, thereby driving the spool and the flywheel to rotate thereby initiating combustion.

Consumers demand that rope engines start with as little manual input as necessary. It is preferred that the engine start on the first pull. Accordingly, engine control units are used to control fuel injection and/or ignition systems to optimize engine start-up and engine running. Not only does the engine control unit improve engine start-up, the engine control unit manages engine operation so as to optimize engine operation. Accordingly, the engine control unit is programmed to assess engine operation from a myriad of sensors and, based on that feedback, control engine operation to satisfy stringent environmental concerns, fuel efficiency requirements, reduce noise emission, and meet the power loads placed on the engine.

In particular, some modern engines, such as the EVINRUDE® outboard motor, have fuel injectors that are designed to operate at rather high voltages that exceed that which can be provided by standard 12 volt systems. EVINRUDE is a registered trademark of the present assignee. These injectors operate extremely fast and responsive, and are not only state-of-the-art in terms of performance, they are so highly tuned that engines so equipped greatly exceed environmental emissions standards for years to come. However, to obtain such exacting performance, the injectors operate at a rather high voltage, preferably 55 volts.

To provide the requisite higher voltages to power these fuel injectors and other systems of the engine, alternators are commonly used to translate the engine's mechanical energy to electrical energy. The electrical energy, once properly conditioned, may then be used to drive the fuel injectors and/or other electronics of the engine or motor. Accordingly, these newer 55 volt systems require more robust alternators and electronics to control not only the high voltage components, but also any lower voltage components, such as 12 volt fuel and oil pumps. With a rope-start engine, it is difficult to apply a pulling force on the rope to induce generation of electrical energy sufficient to supply all these needs on just one pull. As such, the operator may be required to make several pulls.

Generally, when the engine is running, the alternator converts mechanical energy of a rotating engine to electrical energy. In this regard, the alternator provides an AC output that is input to a rectifier to convert the AC output of the alternator to DC. The DC output of the rectifier is then fed to a filter capacitor to remove transients in the DC output of the rectifier. The output of the filter capacitor is then used to form a DC rail voltage that is used to power the engine and motor electronics. In other words, during engine running, the filter capacitor is charged. However, when the engine stops running, the capacitor, which is constantly connected to the various engine electronics across the voltage rail, is drained of its stored energy. As such, after the engine stops running, the capacitor continues to provide a rail voltage for a brief period of time, usually milliseconds, until it is completely drained or depleted of its stored energy. Accordingly, in an engine restart, the filter capacitor must be recharged to provide the requisite rail voltage for engine component operation. For rope-start engines with high current demands and/or higher voltage requirements, this can be particularly difficult.

A number of techniques have been developed to improve and ease the starting of rope-start engines. One such technique is described in commonly assigned U.S. Ser. No. 09/579,973. Notwithstanding the advancements of these improved starting techniques, with the advent of higher voltage requirements and/or high current needs, there is room for improvement.

It would therefore be desirable to design a system to maintain electrical charge in an energy storage device to ease and improve starting of an engine.

BRIEF DESCRIPTION OF INVENTION

The present invention is directed to system that stores energy and prevents loss thereof to ease starting of an engine that overcomes the aforementioned drawbacks.

An enablement circuit is disclosed that selectively opens and closes a conductive path between a chargeable electrical energy source and electronics of an engine/motor. The enablement circuit selectively closes and opens the conductive path based on feedback received regarding engine operating status. More specifically, a crank position sensor provides feedback as to the rotational position of a rotating component of an engine to the enablement circuit. In this regard, when the rotating component, e.g. crankshaft or flywheel, is rotating, the enablement circuit closes the conductive path and allows the transference of electrical energy from the energy source to the engine and motor electronics. Conversely, when feedback is received indicative of non-rotation of the rotating component, the enablement circuit opens the conductive path. As such, energy stored in the energy source remains stored. Therefore, with a subsequent detection of initial rotation of the rotating component, the conductive path is immediately closed and the stored energy is allowed to pass to the engine and motor electronics, thereby, allowing rapid powering of the engine and motor electronics.

Therefore, in accordance with one aspect of the present invention, an engine electronics power management system is provided that includes an energy source to convert mechanical energy from an engine to electrical energy. An engine operation sensor is disclosed and configured to provide feedback regarding engine operating status to a controller. The controller is operationally connected to the engine operation sensor to receive the feedback as to engine operating status and configured to prevent transference of electrical energy from the energy source to an engine electronic upon engine shut-down.

In accordance with another aspect, the present invention includes an electronically controlled engine having a flywheel assembly designed to rotate and generate electrical energy during engine operation. An energy storage device is connected to receive electrical energy from the flywheel assembly. The engine also includes an engine electronic component that is powered by the electrical energy. A selectively controlled power switch is provided that when closed electrically connects the energy storage device and the engine electronic and when opened electrically disconnects the energy storage device from the engine electronic.

According to yet another aspect of the invention, an outboard motor includes an internal combustion engine to provide thrust for a watercraft. A non-battery electrical energy source is provided and is charged during engine operation. The energy source is also configured to maintain an electrical charge absent a load placed thereon. The outboard motor further includes an engine control unit (ECU) to control operation of the internal combustion engine and an ECU enablement circuit. The enablement circuit is configured to electronically connect the ECU to the non-battery electrical energy source during engine operation and electrically disconnect the ECU from the non-battery electrical energy source during engine non-operation.

In a further aspect, the present invention includes a recreational engine control having means for providing electrical power and an ECU powered by the means for providing electrical power. The engine control further has means for indicating rotational movement and means for storing electrical energy. Means for preventing loss of the stored electrical energy is also provided.

Various other features, objects and advantages of the present invention will be made apparent from the following detailed description and the drawings.

BRIEF DESCRIPTION OF DRAWINGS

The drawings illustrate the best mode presently contemplated for carrying out the invention.

In the drawings.

DETAILED DESCRIPTION

Figure 1:
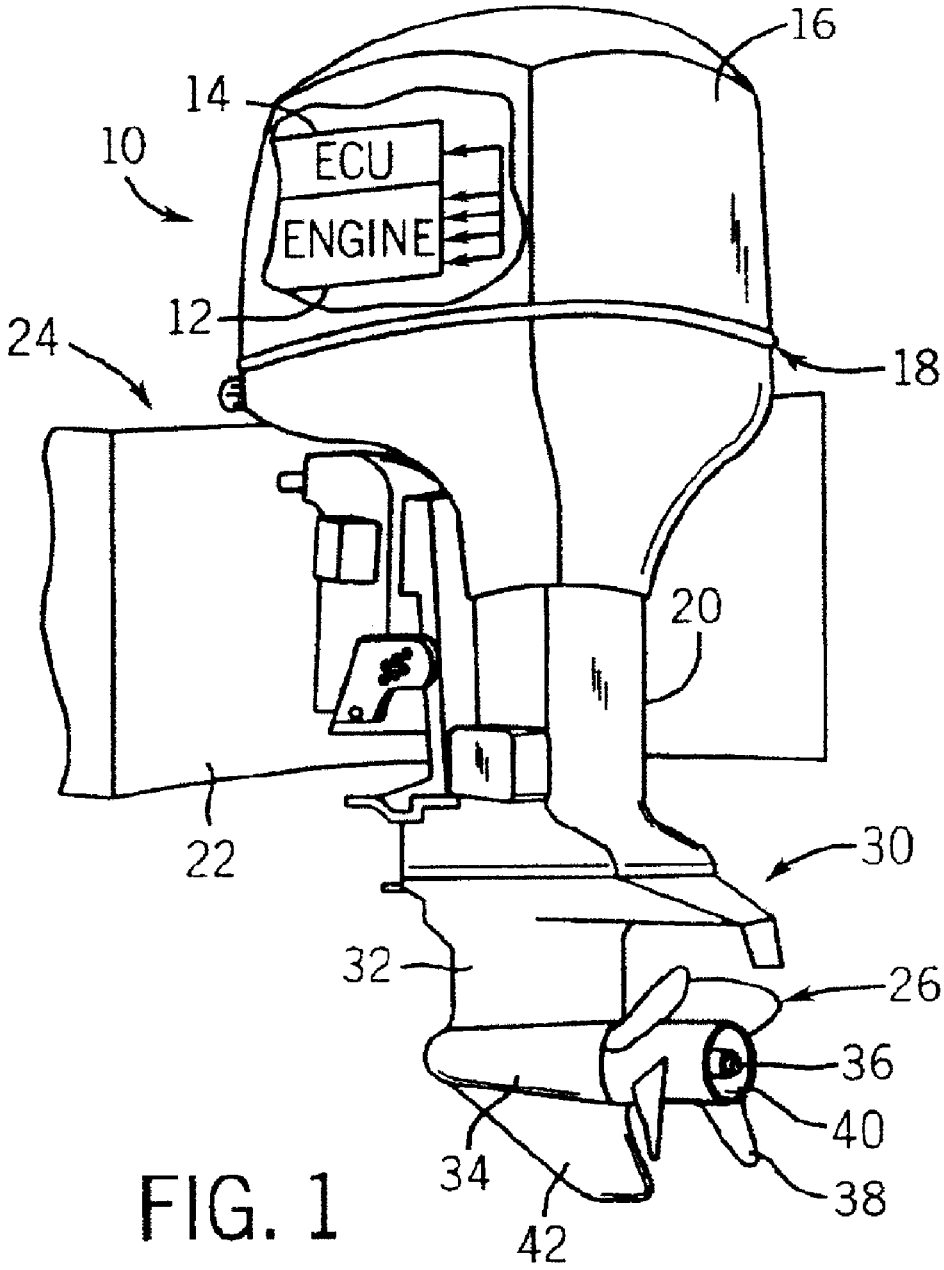
FIG. 1 is a perspective view of an exemplary outboard motor incorporating the present invention.

The present invention relates generally to internal combustion engines, and preferably, to those whose operations are controlled by an engine management module (EMM), or more generally, by a control unit or ECU. FIG. 1 shows an outboard motor 10 having an engine 12 controlled by a control unit 14 mounted directly to the engine under engine cover 16. Engine 12 is housed generally in a powerhead 18 and is supported on a mid-section 20 configured for mounting on a transom 22 of a boat 24 or other water-going vessel in a known conventional manner. Engine 12 is coupled to transmit power to a propeller 26 to develop thrust and propel boat or other watercraft 24 in a desired direction. The motor 10 includes a lower unit 30 having a gear case 32 that includes a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via mid-section 20. A skeg 42 depends vertically downwardly from torpedo section 34 to protect propeller fins 38 and encourage the efficient flow of outboard motor 10 through water. One skilled in the art will appreciate that engine 12 may be either a two-cycle or a four-cycle internal combustion engine and either fuel injected or carbureted; however, in a preferred embodiment, engine 12 is a two-cycle direct fuel injected engine that may be used in various modalities that include an outboard motor, inboard motor, snowmobile, ATV, PWC, or various lawn and garden applications and equipment. Additionally, the engine may be either electronically started or manually started.

Moreover, while many believe that two-stroke engines are generally not environmentally friendly engines, such preconceptions are misguided in light of contemporary two-stroke engines. Modern direct injected two-stroke engines and, in particular, EVINRUDE® outboard motors, are compliant with not only today's emission standards, but emission standards well into the future. Further, the illustrated outboard motor has fuel injectors that are extremely fast and responsive. These injectors are not only state-of-the-art in terms of performance, they are so highly tuned that engines so equipped greatly exceed environmental emissions standards for years to come. To obtain such exacting performance, the injectors operate at a rather high voltage, preferably 55 volts.

Figure 2:
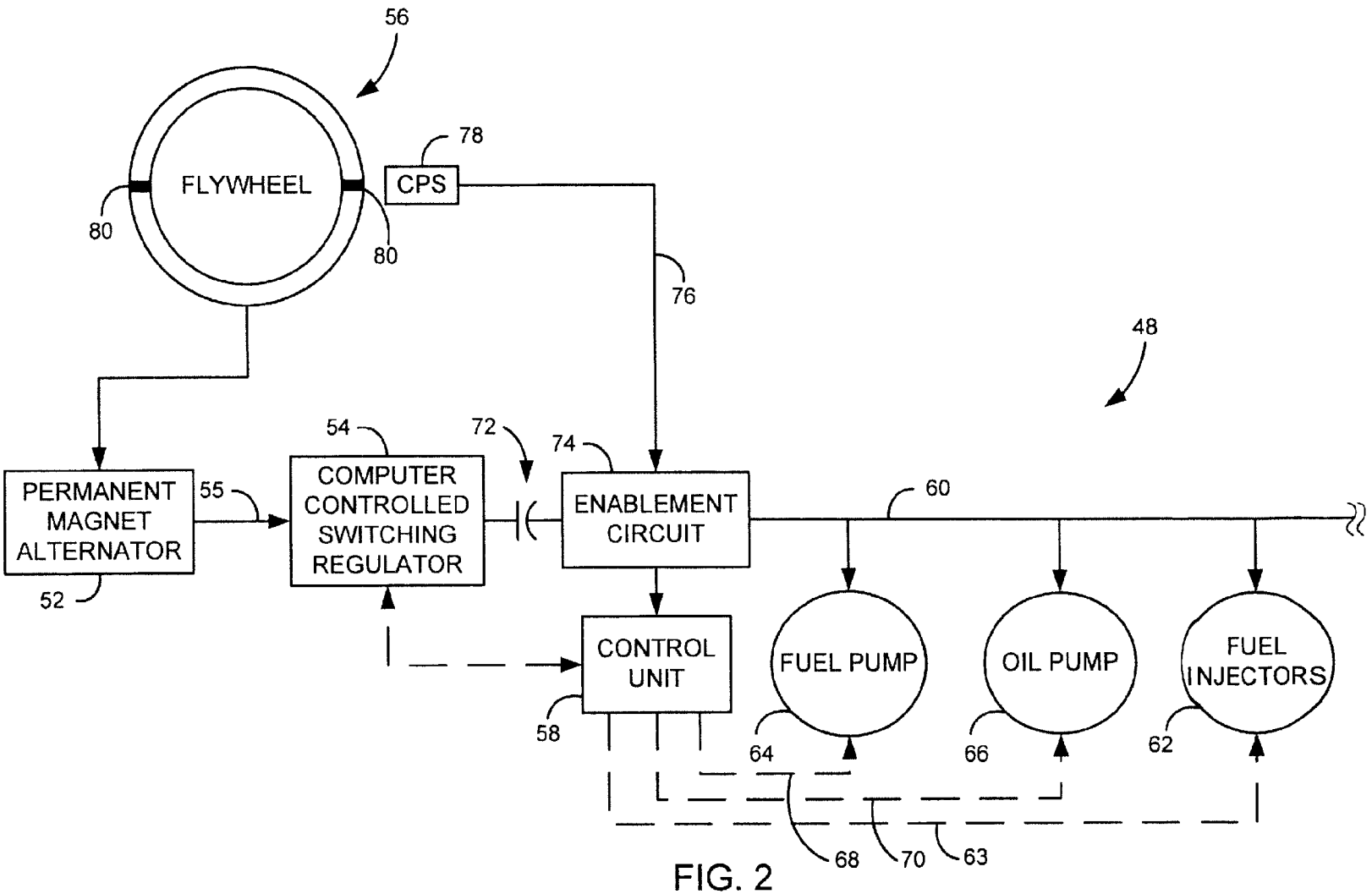
FIG. 2 is a block diagram of an engine control unit enablement system according to one aspect of the present invention.

Referring now to FIG. 2, the electrical and electronics system 48 of motor 10 is schematically shown. The electrical system includes an energy source assembly that includes a permanent magnet alternator 52 and a computer controlled switching regulator 54 to provide electrical power to the motor's electronics. In accordance with well-known alternator operation, the alternator 52 produces alternating current (AC) 55 by converting the engine's mechanical energy into alternating electrical current during engine operation. In this regard, a portion of the mechanical energy generated by the engine crankshaft during engine operation is translated to the alternator 52 for generation of AC. In the illustrated example, a flywheel 56, which is directly or indirectly driven by the engine crankshaft, translates the engine's mechanical energy to the alternator 52. Engine electronics generally operate with direct current (DC), therefore, an AC to DC converter is customarily used to condition the AC signal generated by the alternator to provide a DC signal usable by the engine electronics. In a preferred embodiment however, a computer controlled switching regulator 54 converts the AC output of the alternator 52 into DC. In this regard, the regulator 54 is controlled by a dedicated control unit 58 or is controlled by the ECU.

The regulator 54 is controlled to provide a DC signal at a desired rail voltage, generally referenced 60, that is used to provide power to the various electronics of the engine and motor. In one embodiment, the regulator is dynamically controlled to provide a rail voltage ranging from 12 to 60 volts and, preferably, to provide a 55 volt rail voltage for powering the motor's electronics. While it is customary to provide a 12 volt rail voltage, engine operation is optimized with a rail voltage greater than 12 volts. For instance, as noted above, the fuel injectors 62 are controlled by control unit via control line 63 to optimally run on a 55 volt rail. It is contemplated that other engine components such as a fuel pump 64 or an oil pump 66 may also be operated on a 55 volt rail. It is further contemplated that standard, off-the-shelf fuel and oil pumps may be controlled via control lines 68 and 70, respectively, by the control unit 58 to operate at a rail voltage that exceed their rated maximums. Controls for such off-the-shelf pumps are disclosed in commonly assigned and co-pending applications U.S. Ser. Nos. 10/708,089 and 10/708,087.

Still referring to FIG. 2, the DC output of switching regulator 54 is input to a filter capacitor 72 that removes transients from the DC output, but also stores electrical energy in accordance with its capacitive characteristics. As is generally well-known, a capacitor stores electrical energy upon receipt of a DC input and stores that electrical energy when an electrical load is removed therefrom. In this regard, the output of the filter capacitor 72 provides the DC voltage rail heretofore described when electrically connected to any of the engine or motor electronics. On the other hand, when electrically disconnected from the engine and motor electronics, if charged, the capacitor will maintain that charge. In this regard, the DC voltage rail 60 used to power the various engine and motor electronics forms a conductive path between the engine and motor electronics and the filter capacitor 72.

As previously described, capacitors will continue to supply electrical charge to a load if electrically connected to the load independent of the inputs to the capacitors. Therefore, to prevent discharge of the stored electrical energy of capacitor 72, the present invention includes an enablement circuit 74 that selectively opens and closes the conductive path between the filter capacitor 72 and the engine and motor electronics. More particularly, the enablement circuit, when controlled to open the conductive path, prevents the flow of electrical energy to any of the engine and/or motor electronics. Accordingly, electrical energy is stored in the capacitor that may be accessed relatively quickly when the conductive path is subsequently closed. That is, the electrical energy stored in the filter capacitor 72 may be used to power the engine and motor electronics near-immediately after the conductive path is closed rather than wait for the generation of the necessary rail voltage by the alternator and switching regulator described herein.

The enablement circuit selectively closes and opens the conductive path based on feedback 76 received from an engine crankshaft position sensor (CPS) 78. Sensor 78, in one embodiment, is a crank position sensor and provides feedback 76 as to the rotational position of a rotating component of the engine. For instance, flywheel 56, which is driven by the engine's crankshaft (not shown), includes one or more indicators 80 that when detected provide an indication of engine operation. That is, detection of an indicator 80 traveling past sensor 78 is indicative of a rotating flywheel which is indicative of an engine start. Conversely, the lack of detection of an indicator 80 within a set time interval would be indicative of engine non-operation. In a preferred embodiment, indicators 80 include magnetic teeth and sensor 78 is a magnetic pick-up device such as a ferromagnetic transducer or a Hall effect sensor.

Based on rotation or lack thereof of the flywheel or other rotating component of the engine, enablement circuit selectively opens and closes the conductive path between the filter capacitor 72 and the engine and motor electronics. Specifically, the enablement circuit, based on the feedback 76 received from CPS 78, determines whether or not the flywheel 56 is rotating. If so, the conductive path is closed. If not, the conductive path is opened. Closing of the conductive path allows the transference of electrical energy from the filter capacitor 72 to the electronics. Opening the path prevents electrical energy flow therethrough.

In a preferred embodiment, a single indicator 80 is used to provide an indication of flywheel rotation. However, it is contemplated that more than one indicator may be used. The enablement control unit may also include processors and other circuitry to compare the temporal difference in detection of an indicator. In this regard, the enablement circuit may more precisely monitor engine operation. For example, based on the timing between detection of an indicator, the enablement circuit may reasonably ascertain whether the rotational speed of the flywheel as dropped below an engine idle rotation speed. In this regard, the enablement circuit may open the conductive path to prevent transference of electrical energy from the filter capacitor when engine speed has dropped below a level that does not support engine idling. As such, the amount of incidental electrical energy depletion from the filter capacitor may be reduced.

Accordingly, the enablement circuit is presented that selectively closes a conductive path between a chargeable electrical energy source and electronics of an engine/motor. The enablement circuit selectively closes and opens the conductive path based on feedback received regarding engine operating status. More specifically, the crank position sensor provides feedback as to the rotational position of a rotating component of an engine to the enablement circuit. In this regard, when the rotating component, e.g. crankshaft or flywheel, is rotating, the enablement circuit closes the conductive path and allows the transference of electrical energy from the energy source to the engine and motor electronics. Conversely, when feedback is received indicative of non-rotation of the rotating component, the enablement circuit opens the conductive path. As such, energy stored in the energy source remains stored. With a subsequent detection of rotation of the rotating component, the conductive is closed and the stored energy is allowed to pass to the engine and motor electronics, thereby, allowing faster powering of the engine and motor electronics.

Figure 3:
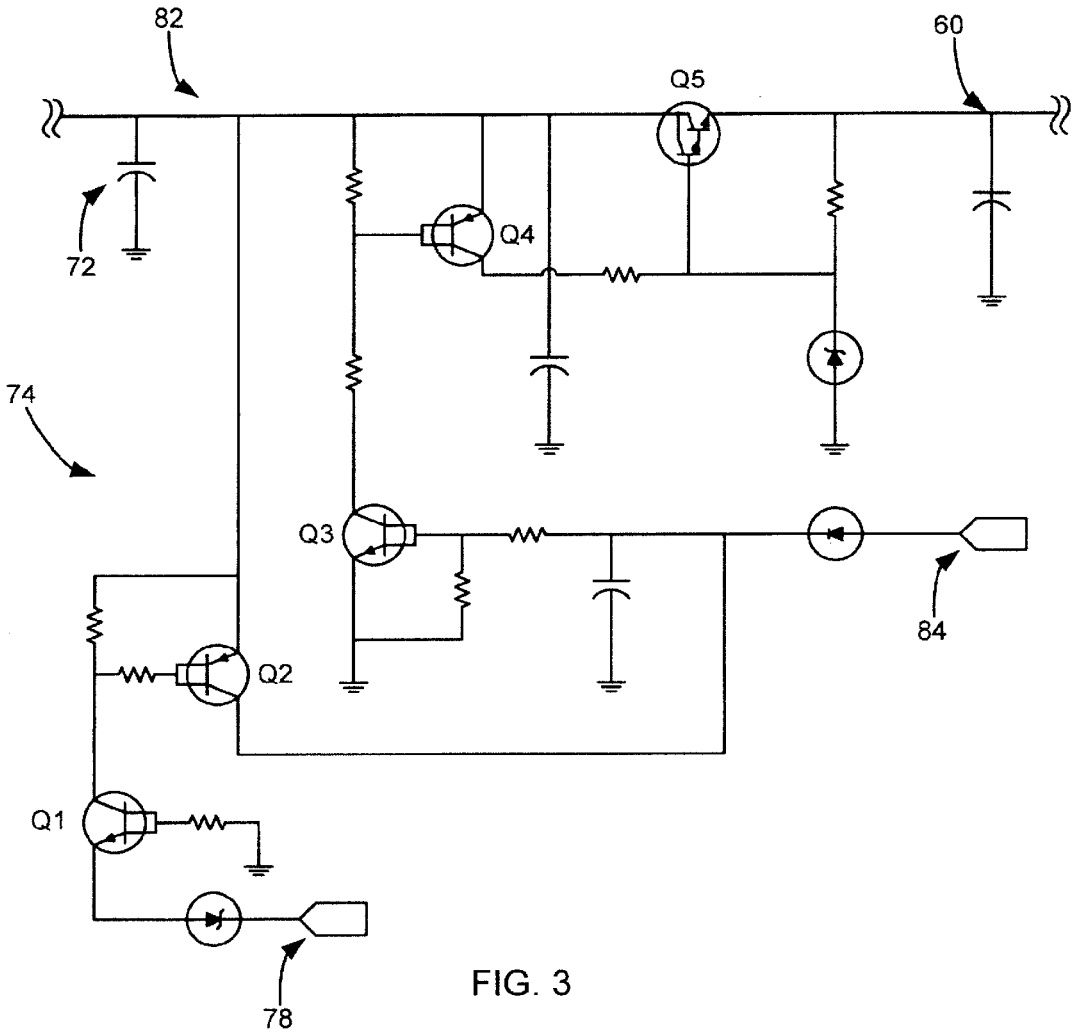
FIG. 3 is a schematic of one exemplary enablement circuit according to the present invention.

One exemplary configuration of the enablement circuit heretofore described is schematically shown in FIG. 3. One skilled in the art will readily appreciate that other configurations are contemplated and may be used. As described above, a conductive path 82 between the filter capacitor 72 and engine electronics is selectively closed and opened based on feedback received by the CPS 78. In this regard, the output of the CPS will selectively bias switch Q1 based on the operating status of the engine. In the exemplary circuit, a negative going voltage output by the CPS indicative of flywheel slowing down or non-rotation causes switch Q1 to be pulled to ground. As a result, the voltage seen at switch Q2 is sufficient to allow the output voltage of the filter capacitor 72 to pull switch Q3 to ground. Pulling switch Q3 to ground will then cause the voltage applied at the base of switch Q4 to overcome the switch's bias, normally 0.5 volts for a bipolar junction transistor (BJT). Accordingly, voltage seen at the Darlington switch assembly Q5 is sufficient to open the conductive path 82 and prevent the discharging of energy from capacitor 72. One skilled in the art will appreciate that a Darlington configuration is used because of its preferred gate drive characteristics; however, other component configurations may be used. Additionally, circuit 74 includes override terminal 84 that when connected to a battery source will override the CPS and pull Q3 to ground. In this regard, when a battery is connected to provide initial power to the engine and motor electronics, concerns regarding capacitor charge are negated and the voltage of the discharged capacitor will cause switch assembly Q5 to close conductive path 82 to permit the flow of energy from the capacitor to the engine and motor electronics independent of engine operating status.

Therefore, in accordance with one embodiment of the present invention, an engine electronics power management system is provided that includes an energy source to convert mechanical energy from an engine to electrical energy. An engine operation sensor is disclosed and configured to provide feedback regarding engine operating status to a controller. The controller is operationally connected to the engine operation sensor to receive the feedback as to engine operating status and configured to prevent transference of electrical energy from the energy source to an engine electronic upon engine shut-down.

In accordance with another embodiment, the present invention includes an electronically controlled engine having a flywheel assembly designed to rotate and generate electrical energy during engine operation. An energy storage device is connected to receive electrical energy from the flywheel assembly. The engine also includes an engine electronic that is powered by the electrical energy. A selectively controlled power switch is provided that when closed electrically connects the energy storage device and the engine electronic and when opened electrically disconnects the energy storage device from the engine electronic.

According to yet another embodiment of the invention, an outboard motor includes an internal combustion engine to provide thrust for a watercraft. A non-battery electrical energy source is provided and is charged during engine operation. The energy source is also configured to maintain an electrical charge absent a load placed thereon. The outboard motor further includes an engine control unit (ECU) to control operation of the internal combustion engine and an ECU enablement circuit. The enablement circuit is configured to electronically connect the ECU to the non-battery electrical energy source during engine operation and electrically disconnect the ECU from the non-battery electrical energy source during engine non-operation.

In a further embodiment, the present invention includes a recreational engine control having means for providing electrical power and an ECU powered by the means for providing electrical power. The engine control further has means for indicating rotational movement and means for storing electrical energy. Means for preventing loss of the stored electrical energy is also provided.

The present invention has been described in terms of the preferred embodiment, and it is recognized that equivalents, alternatives, and modifications, aside from those expressly stated, are possible and within the scope of the appending claims. While the present invention is shown as being incorporated into an outboard motor, the present invention is equally applicable with other recreational products, some of which include inboard motors, snowmobiles, personal watercrafts, all-terrain vehicles (ATVs), motorcycles, mopeds, power scooters, and the like. Therefore, it is understood that within the context of this application, the term "recreational product" is intended to define products incorporating an internal combustion engine that are not considered a part of the automotive industry. Within the context of this invention, the automotive industry is not believed to be particularly relevant in that the needs and wants of the consumer are radically different between the recreational products industry and the automotive industry. As is readily apparent, the recreational products industry is one in which size, packaging, and weight are all at the forefront of the design process, and while these factors may be somewhat important in the automotive industry, it is quite clear that these criteria take a back seat to many other factors, as evidenced by the proliferation of larger vehicles such as sports utility vehicles (SUV).

What is claimed is:

1. An engine electronics power management system comprising:

an energy source to convert mechanical energy from an engine to electrical energy;

an engine operation sensor configured to provide feedback regarding engine operating status;

a controller connected to the engine operation sensor to receive the feedback as to engine operating status and configured to prevent transference of electrical energy from the energy source to an engine electronic upon engine shut-down; and the engine operation sensor including an engine position sensor designed to provide feedback of rotational position of a rotary component of the engine.

2. The system of claim 1 wherein the engine position sensor is a crank position sensor situated to provide feedback regarding a rotational position of a flywheel driven to rotate during engine operation.

3. The system of claim 2 wherein the controller is connected to allow powering of an engine electronic upon detection of a rotating flywheel and prevent transference of stored energy from the energy source upon detection of a non-rotating flywheel.

4. The system of claim 3 wherein the engine electronic is an engine control unit.

5. An engine electronics power management system comprising:

an energy source to convert mechanical energy from an engine to electrical energy;

an engine operation sensor configured to provide feedback regarding engine operating status;

a controller connected to the engine operation sensor to receive the feedback as to engine operating status and configured to prevent transference of electrical energy from the energy source to an engine electronic upon engine shut-down;

the energy source including an alternator constructed to output AC power during engine operation and an AC/DC converter designed to condition AC power received from the alternator into DC power used to power the engine electronic, and an energy storage device that when charged is configured to store electrical energy engine upon shut-down; and a power switch connected between the energy storage device and the engine electronic, and wherein a closing of the power switch allows transference of electrical energy from the energy storage device to the engine electronic.

6. The system of claim 5 wherein the energy storage device is a filter capacitor and wherein the filter capacitor is charged with DC power received by the AC/DC converter during engine running.

7. An electronically controlled engine comprising:

a flywheel assembly configured to rotate and generate electrical energy during engine operation;

an energy storage device connected to receive electrical energy from the flywheel assembly;

an electronic component that is powered by the electrical energy; and a selectively controlled power switch that when closed electrically connects the energy storage device and the electronic component and when opened electrically disconnects the energy storage device from the engine electronic component.

8. The engine of claim 7 wherein the electrical energy source includes an AC/DC converter connected to the flywheel assembly and designed to convert an AC input to a DC output.

9. The engine of claim 7 wherein the AC/DC converter is a rectifier.

10. The engine of claim 8 wherein the energy storage device includes a filter capacitor connected to the AC/DC converter to remove transients in the DC output.

11. The engine of claim 7 further comprising an engine position sensor configured to provide feedback of engine position to the selectively controlled power switch.

12. The engine of claim 11 wherein the engine position sensor is a crank position sensor designed to provide feedback regarding flywheel rotational position.

13. The engine of claim 12 wherein the flywheel assembly having a flywheel that includes at least one position indicator that is monitored during flywheel rotation by the crank position sensor.

14. The engine of claim 7 wherein the energy storage device is configured to store electrical energy during flywheel rotation and maintain electrical storage sufficient to power the engine electronic unit upon subsequent non-rotation of the flywheel.

15. The engine of claim 7 wherein the engine electronic includes an engine control unit.

16. An outboard motor comprising:

an internal combustion engine to provide thrust for a watercraft;

a non-battery electrical energy source that is charged during engine operation and configured to maintain an electrical charge absent a load placed thereon;

an engine control unit (ECU) configured to control operation of the internal combustion engine;

an ECU enablement circuit configured to electronically connect the ECU to the non-battery electrical energy source during engine operation and electrically disconnect the ECU from the non-battery electrical energy source during engine non-operation; and a crank position sensor configured to provide feedback regarding position of a crankshaft to the ECU enablement circuit.

17. The outboard motor of claim 16 wherein crankshaft position is monitored via indicators on a flywheel operationally connected to the crankshaft.

18. The outboard motor of claim 16 wherein the non-battery electrical energy source includes a filter capacitor that is charged during engine operation and maintains an electrical charge upon non-operation of the internal combustion engine.

* * * * *